US005422130A

United States Patent [19]

Fox et al.

[11] Patent Number: 5,422,130

[45] Date of Patent: Jun. 6, 1995

[54] COMMERCIALLY STERILE FOOD PACKAGING SYSTEM

[75] Inventors: Robert W. Fox, Williamsburg; Joseph E. Marcy, Blacksburg, both of Va.

[73] Assignee: Pressure Pack, Inc., Williamsburg, Va.

[21] Appl. No.: 971,210

[22] Filed: Nov. 4, 1992

[51] Int. Cl.[6] ..... A23L 1/025

[52] U.S. Cl. ..... 426/234; 99/367; 99/371; 99/443 C; 99/470

[58] Field of Search ..... 422/297, 298, 299, 300, 422/304, 307; 99/356, 361, 366, 367, 371, 443 R, 443 C, 478, 517; 53/432, 440, 127, 111 R, 510, 266.1, 274, 275; 426/392, 399, 407, 408, 412, 234; 141/51, 69, 82

[56] References Cited

U.S. PATENT DOCUMENTS

| | | | |
|---|---|---|---|
| 2,541,113 | 2/1951 | Smith, Jr. et al. . | |
| 2,639,991 | 5/1953 | Ball . | |
| 2,909,436 | 10/1959 | Inghram | 426/408 |
| 3,241,475 | 3/1966 | Schack et al. . | |
| 3,291,563 | 12/1966 | Martin | 99/361 |
| 4,409,775 | 10/1983 | Brody et al. . | |
| 4,637,936 | 1/1987 | White et al. . | |
| 4,646,629 | 3/1987 | Creed et al. | 99/361 |
| 4,674,267 | 6/1987 | Szemplenski et al. . | |
| 4,874,580 | 10/1989 | Sugisawa et al. . | |
| 4,962,700 | 10/1990 | Skouic et al. | 99/361 |
| 5,053,196 | 10/1991 | Ide et al. | 426/407 |
| 5,059,392 | 10/1991 | Wijts | 426/407 |

FOREIGN PATENT DOCUMENTS

| | | |
|---|---|---|
| 2407135 | 10/1977 | France . |
| 2565556 | 12/1985 | France . |
| 2006605 | 5/1979 | United Kingdom . |

*Primary Examiner*—Robert A. Dawson
*Assistant Examiner*—W. L. Walker
*Attorney, Agent, or Firm*—Barnes & Thornburg

[57] ABSTRACT

A modular system wherein a wide range of fluid and/or particulate food products are filled and sealed into rigid, semi-rigid or flexible containers at commercial sterilizing temperature and under pressure in a non-aseptic method. The machine is pressurized with an inert gas so that in-container oxygen volume is minimized and product evaporation is minimized. Sterilization and subsequent cooling is achieved in holding towers controlled at appropriate temperatures and pressures. Modular construction enables the whole machine to be tailored to suit specific food product and container applications and allows the filling and sealing sections of the machine to be very small.

13 Claims, 6 Drawing Sheets

COMMERCIALLY STERILE FOOD PACKAGING SYSTEM

TECHNICAL FIELD

The present invention applies generally to food packaging and sterilization system and more specifically to a food packaging and sterilization system for rigid, semi-rigid and flexible containers.

DESCRIPTION OF THE PRIOR ART

The principles of food packaging and sterilization have been well established for many years. Two types of processes have emerged; aseptic and non-aseptic.

An aseptic system sterilizes food separately from the container and closure and then "assembles" all three in a sterile chamber. This is ideally suited to pumpable fluid food products which pass easily through heat exchangers and which achieve sterilization temperatures quickly. The process allows appropriate products to achieve high standards of quality since little excess thermal damage is done during heating. A typical example of an aseptic system is U.S. Pat. No. 4,637,936.

Non-aseptic systems are much more common and have been employed for much longer. Food is filled and sealed into non-sterile containers in a non-sterile environment. The assembly is then subjected to a temperature/time regime which ensures that sufficient heat passes through the container and food to the point of slowest heating to achieve commercial sterility at that point and all others in the container. These systems are suitable for both fluid and particulate products but generally achieve lower standards of quality because of the excessive heat damage done to the majority of the container's contents as heat passes to the slowest heating point.

U.S. Pat. No. 3,241,475 describes a non-aseptic process which uses a pressurized chamber to house filling and sealing machinery together with production operators. The pumpable products are filled and sealed at sterilizing temperatures and then held for a time, to achieve commercial sterility. The process known as "Flash 18" because of the chamber pressure (18 psi), employed a series of lobe pumps to deliver food to the filling machine inside the chamber, via an indirect heat exchanger or a direct steam injection zone and a flash de-aerator. The product arrived at the required moisture level and without the off-flavors normally associated with canned products. Sterilization was achieved by holding the sealed containers at sterilizing temperature for the appropriate time (about 5 minutes). Cooling was generally effected in an external system, depending on can size.

The "Flash 18" process has been in commercial use for many years but suffers from a number of major disadvantages. These include the need for large scale pressurized chambers to house all the equipment, the need to include operators inside the pressurized environment, the losses in large particulate product integrity in the series of lobe pumps, the inability to fill into flexible and semi-rigid containers with out serious risk to container integrity and the inability to reduce the level of oxygen enclosed in the container at the point of sealing.

U.S. Pat. No. 4,674,267 describes a processing and packaging system for flexible packaging based on the "Flash 18" process and including the large pressurized chamber which improves the handling of pumpable food products. By using constant pressure delivery system and a conduit open to the pressurized chamber, mechanical damage to the product is avoided. The system used nitrogen or other inert gases to minimize oxygen content of the filled container. Since the only containers used were rigid cans or collapsible pouches, the containers were over filled to remove air space. Also, the cooling and decompression of the sterilized packages was not controlled. This system could not maintain the integrity of the seals of semi-rigid, easy open containers.

DISCLOSURE OF THE INVENTION

The present system combines the merits and avoids the problems of both systems. A wide range of both fluid and particulate foods arrives at the filling chamber at sterilizing temperature. Excessive heat damage is avoided since sterilization is not achieved until after the container is sealed. This avoids the need to ensure and maintain asepsis. The present system produces a wide range of non-aseptically sterilized foods of very high quality with properties which promote long shelf life.

The present system overcomes the disadvantages of U.S. Pat. No. 3,241,475 described earlier and greatly improves upon the method by providing a significantly smaller machine which does not house operators, mechanics or drive mechanisms within the pressurized chamber. The system is capable of filling a wide range of fluid and particulate products including large single portion particulates, into rigid, semi-rigid and flexible packaging without package distortions likely to limit package integrity and with a low level of contained oxygen.

The present system also improves upon U.S. Pat. No. 4,674,267 by not requiring a pressure chamber sufficiently large for human entry to accomplish mechanical service. The present system eliminates the need for human entry by providing a novel telescoping design and/or access panels to the pressure chambers and by placement of all drive, electrical and electronic control components outside the pressure chambers. The present system also does not require a constant diameter conduit with open communication to the filling chamber in order to achieve constant pressure in the upstream food processing equipment. Constant back pressure will be provided by the differential pressure between the feed pump and the filling valve located within the pressurized filling chamber, either with or without a pressurized surge vessel prior to product entry to the filling valve. This arrangement eliminates the product damage produced by the back pressure pump in U.S. Pat. No. 3,241,475 and the need for constant, uninterrupted product flow through a constant diameter conduit as described in U.S. Pat. No. 4,674,267.

The present system for packaging and sterilizing food includes a first container section for raising the temperature and pressure of one or more containers to a filling temperature and pressure. This is followed by a filling chamber wherein the container is filled with food at a filling temperature and pressure received from a third section which feeds food at the filling temperature. The filling chamber is followed by a sealing chamber which seals the filled container at the filling temperature and required pressure. This is followed in turn by a holding section where the sealed container is held at sterilizing temperature for the required time and then sequentially reduces the temperature and pressure of the sterilized containers. Pressure locks are provided between the various sections for maintaining the pressure in each of the sections. The holding and reduction section includes at least one hold stage and one or more cooling and pressure reduction stages to bring the container to an ambient temperature and pressure without collapsing the container or compromising the seal integrity.

The temperatures in the various filling and sealing stations may be maintained at temperatures different from each other, but at no less than 100° C. which is defined as commercially sterile. Steam and/or inert gases are provided in the filling and sealing section at the filling temperature and required pressure. The filling temperature and required pressure are selected so as to minimize production of steam. An increase in pressure of the inert gas assures an appropriate density of inert gas in the container during the cool down and depressurization such that the container does not collapse nor is the seal compromised.

Various sections and the locks are modular. This allows a wide range of individually tailored subsections to be available such that the system can be designed for various packages and products. The transport portion of each module is self-contained so as to be integral with the module. This allows freedom of design to suit a wide range of applications and factory layouts and allows easy transportation. The filling and sealing modules are designed to include a first section having an access port and a second housing section telescopically mounted to the first section for sealing or exposing the access port. This allows access to the interior of the housing section to allow maintenance without requiring disassembly of the subsections from each other or from the pressure locks. The assembly of the pressure locks includes two telescopically connected sections providing access to the lock. A pair of lock ring mounts the two locking sections to a respective adjacent module.

The transports in the container handling, filling, sealing, and sterilization sections may be standard conveyors. The locks include a unique transfer mechanism. The lock transfer mechanism extend through an open door in the lock into an adjacent section or chamber to receive one or more containers. The gripper is retracted into the lock and the inlet door is closed. Next the outlet door is open and the transfer mechanism with the container is extended into the next adjacent stage to deposit the container therein. The transfer mechanism is then retracted into the lock and the outlet door is closed. The transfer mechanism includes a gripper for extending through the doors to retrieve, carry and deposit the one or more containers and a pivot arm pivotally connected to the first end of the gripper and to a pivot point at the second end. A drive rotates the pivot arm about the pivot point to extend or retract the gripper. The first end of the pivot arm is selectively connected to the gripper at a first or second pivot position and the second end is selectively pivoted about a first or second pivot point, A selection mechanism selects the first pivot position and the first pivot point or the second pivot position and the second pivot point. The first pivot position and the first pivot point are diametrically opposed with respect to the length of the lock as are the second pivot position and second pivot point with respect to each other.

BEST MODES FOR CARRYING OUT THE PRESENT INVENTION

Figure 1:
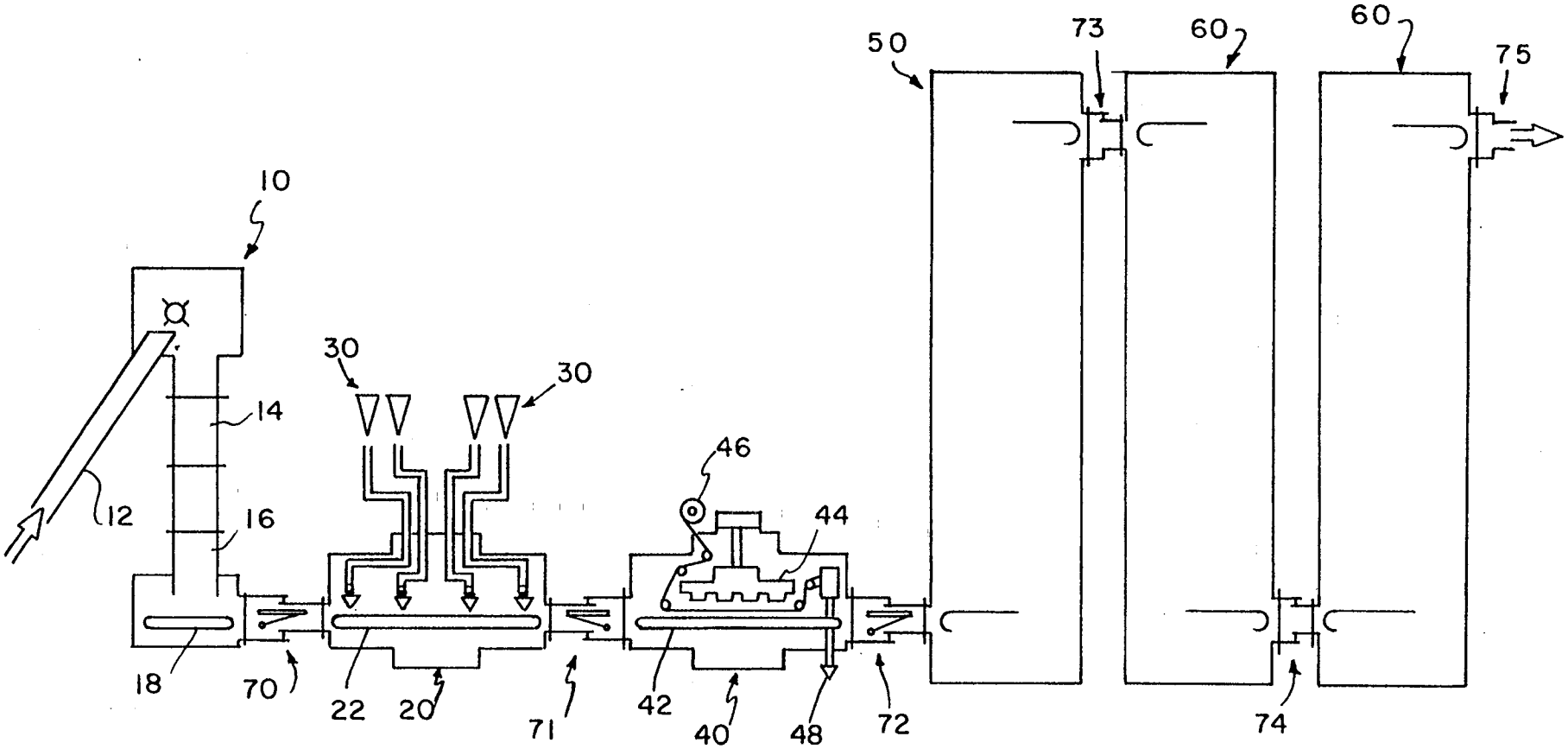
FIG. 1 is a diagrammatic view of a food packaging and sterilization system incorporating the principles of the present invention.

FIG. 1 illustrates the system of the present invention wherein containers are pre-heated and pressurized in a container feed handling section 10 to a filling temperature and pressure. They are then transported to a filling station or chamber 20 whose environment is controlled to a filling temperature and pressure and receives food from sources 30 at a filling temperature and pressure. The filled containers are then transferred to a sealing station or chamber 40 wherein the containers are sealed at a filling temperature and pressure. The sealed containers are then transferred to a sterilization section 50 where they are held at the desired sterilization temperature for the appropriate amount of time for the product to meet FDA standards. The sterilized containers are then processed through a plurality of cooling and depressurization sections 60 wherein the pressure and temperature of the packages are slowly lowered so as to prevent the collapse of the containers and to avoid compromising the integrity of the seal. The containers exit the system at substantially ambient conditions.

Pressure locks 70–75 are provided between the various sections of the system. The pressure locks not only maintain the pressure within the various sections, but also contribute to the modularity of the system. Although maintained at the filling temperature in the various sections leading up to the hold sections 50, the food is not held at a raised temperature for a sufficient amount of time until it reaches the hold chamber 50 to commercially sterilize the food product.

The modular designed allows a wide range of individually tailored subsystems to be available to suit various types of packages and food products. Also the modular design allows each subsection to be small and compact. This allows the design to fit in existing production space or to be installed on railroad cars, trucks or small barges to permit its use locally, at product growing/preparation areas or areas of large population density and low food preservation capability.

The container feed sub-system 10 includes three major sub-assemblies; package lift 12, heating zone 14, and load zone 16. Empty containers are deposited into the atmospheric pressure side of a first pressure door where initial preheating begins. They are then transferred into the heating zone 14 where pressure is increased to that of the filling chamber 20 and heating continues towards that of the filled product. The packaging material then moves through the second pressure door into a second part of the heating zone 14 where heating is continued until fill temperature is reached and fill pressure is achieved. The packaging then moves through a third pressure door into the load zone 16 where the package is deposited into the container conveyor 18.

Packaging materials fall into four categories; pre-formed rigid containers (e.g. glass or barrier plastic jars, bottles or canisters and metal cans); pre-formed semi-rigid containers (e.g. barrier plastic trays); pre-formed flexible packages (e.g. pre-formed gusseted pouches); and flexible pouches made from reel fed web materials (e.g. simple flexible pouches). Four generic systems designed for traditional rigid packages as well as semi-rigid plastic and flexible materials are to be described.

Pre-formed, semi-rigid containers are unloaded from their manufacturers cartons or pallets, loaded onto inclined conveyors 12 and transported to the top of the container feed section 10 while arranged either one behind or nested into another, as a stack or "stick". At the top of the conveyor 12 a rotating drum with radial mandrels locates inside each container as it is presented, upside down by the conveyor discharge. The mandrels deposit the containers into the atmospheric pressure side of the pressurized heating zone 14, ahead of the pressure door and construct a vertical "stick".

The container "sticks" may be formed within a single column former or within one of a number of formers arranged around a rotating carousel which adds to the capacity of each zone within the section. If a carousel is employed, then container "sticks" are used in order and discharged to the next zone within the section, just before the carousel indexes to the position in which incoming containers are received.

There are four zones inside the container feed section 10, atmospheric heating, pressure zones 1 and 2 and the load zone arranged one above the other with the atmospheric heating zone at the top and the load zone at the base, located just above the container conveyor 18.

The first three zones heat the containers up to or beyond filling temperature. Heating in the atmospheric heating section is accomplished by either direct contact with a hot media (e.g. steam) or by infra-red energy from heaters located in the chamber walls. The two pressure zones increase the pressure of the environment surrounding the containers to that of the filling chamber 20. Heating and pressurizing is accomplished by directing a heated media into the chamber under pressure. The container is maintained at filling chamber temperature and pressure. Each zone is isolated by a pressure door which is arranged to open to allow the transfer of containers from one zone to the next, on demand. The pressure doors are opened in sequence to ensure efficient maintenance of pressure and temperature from the bottom to the top.

The vertical "stick" formed in the atmospheric heating zone is transferred from zone to zone so that at any one time, during normal operation, there is a "stick" of containers in process in each zone. An intermittent motion scroll type container feed mechanism is used to ensure positive movement of each container, to maintain their relative positions during static heating phases and, in the case of the load zone scroll, to ensure positive location in the pockets of the container conveyor 18.

Rigid containers, canisters and bottles enter the system in a similar manner to semi-rigid containers except that they do not nest into one another and so are not handled as "sticks". Instead they are de-palletized by a conventional machine (e.g. Simplimatic Engineering Company) and exit on a conveyor which accelerates them, batch by batch, towards the atmospheric heating zone of the container feed section. Inside the zone, they collect together on an accumulation table which ensures appropriate residence time. When ready, they are discharged through the now-open pressure door into the first of three heating zones where in they are collected on a second accumulation table. The transfer process is repeated until the containers reach the transfer mechanism which loads the containers into the pockets of the container conveyor 18.

Pre-formed flexible containers enter the system folded flat and in stacks, they are unstacked and placed through an arrangement of heating and pressurizing zones similar to that described for pre-formed semi-rigid containers, except that it is arranged horizontally, to arrive at a device which unfolds the container and positions it in the pockets of the container conveyor 18.

Reel-fed materials from which flexible containers are constructed are fed into a standard container forming machine located at the entrance to the atmospheric heating zone and from which open top, erect flexible containers emerge. These are transferred through a horizontal arrangement of zones and locks to that described for pre-formed flexible containers.

The containers on the container conveyor 18 are transferred through a first pressure lock 70 to the filling chamber conveyor 22. Depending upon the design of the lock doors in the container feed section 10, lock 70 may be deleted and the filling chamber conveyor 22 would be at the bottom of the container feed section 10.

The container conveyor 18 and the filling chamber conveyor 22 moves with intermittent or continuous motion and positions the packaging under a series of product entry points which deposit the required amounts of food to assemble the desired recipe or formulation in the container. Product enters the chamber at sterilizing (filling) temperature (typically 121° C.). The product flows may be directed through appropriate filling heads into single or multiple packages/compartments and may consist of any combination of the following product types:

- large portion entrées (in the order of 200 g);
- particulates (in the order of 25 mm cubes) with or without a carrier fluid;
- conventional particulates with or without a carrier fluid;
- fluid products alone (sauces, dairy, slurries, pastes).

Food products are preheated to sterilizing temperature and prepared as required in conventional preparation equipment which is the usual and customary equipment such as kettles, mixers and fluid handling systems which include positive displacement pumps (e.g. Wakesha, Sine, Marlen, Moyno), heating systems (e.g. scraped surface heat exchangers or tubular heat exchangers from Cherry-Burrell or Votator), mixing and de-aeration (e.g. Alfa-Laval).

Prepared food products are pumped to the filling chamber by a feed pump, the consequential down stream pressure of the product in the filling chamber delivery piping system, is sufficient to overcome the back pressure provided by the pressurized filling chamber and the pressure loss across the filling valve(s), to move the product at a volume flow rate which matches the filling rate. The style of feed pump is chosen to match the requirements of the product, for example a centrifugal pump may be suitable for low viscosity liquid products not sensitive to sheer and a positive displacement piston pump may be more suitable for large particulate and delicate products.

The pressure difference across the filling valve(s) (delivery piping system pressure minus filling valve nozzle pressure) is maintained by the food pump according to the rate of product demand. In the case of continuous rotary pumps, differential pressure is adjusted by controlling the rate at which product is bled from the delivery pipe work and directed back to the input side of the feed pump. In the case of intermittent positive displacement piston style pumps, differential pressure is adjusted by the rate at which the pump displaces product which may be either a stroke speed adjustment or a stroke length adjustment.

An inert environment inside the filling chamber is maintained at sterilizing temperature and at a pressure above saturation steam pressure for the given sterilizing temperature, by the utilities sub-system. Maintaining pressures above saturated steam temperatures prevents production of steam from the product, maintaining product quality and liquid loss or changes to the solid/-liquid ratio.

When the product recipe or formulation is assembled as required, the packages move into the second transfer lock 71 which isolates a batch of packages from the filling chamber 20.

On exit from the second transfer lock 71, packages are deposited onto the sealing chamber conveyor 42. It positions packages under sealing tools 44 which construct an hermetic seal between a closure and the package. The sealing tools installed are appropriate for the package and closure type and include the following:

- double seaming heads for metal ends on metal bodies and for metal ends on plastic bodies;
- induction welding heads for metal ends on plastic bodies, foil based flexible pouches and foil based closures for glass bodies;
- heat sealing heads for foil and plastic closures on plastic bodies and for foil based flexible pouches;
- sonic or spin welding for plastic or metal ends on plastic bodies;
- rotating clamps for screw closures Closures are provided from supply 46 in either of two ways:

- preformed closures are supplied by a sub-system with a series of pressure doors, holding chambers and accumulation zones similar to that used to allow access for empty packages in the packaging material feed sub-system;
- film based closures are supplied from reels located outside the sealing chamber 40 and directed through a series of pressure tight rollers driven at a speed which corresponds to the rate at which the sealing system demands lidding film.

Both supply methods incorporate heating and pressurization systems to ensure the closure enters the sealing chamber 40 at the required temperature and without pressure loss from the sealing chamber 40.

In the case of film based closures where a die cutter or knife arrangement is used to separate the shaped closure from the film, the web scrap left in the film is granulated by a sub-system located inside the sealing chamber 40 and exhausted from the sealing chamber 40 in batches, through a series of pressure doors 48 which prevent pressure loss from the sealing chamber.

The inert environment inside the sealing chamber is maintained at sterilizing temperature and at an appropriate pressure (at, above or below that in the filling chamber) by the utilities sub-system. The sealing chamber conveyor 42 is designed to provide support for the open package during the sealing operation to ensure seal integrity is not compromised by preventing product contamination on sealing surfaces. Maintaining an inert environment inside both the filling chamber 20 and sealing chamber 40 minimizes the volume of oxygen enclosed within the package after sealing and maintains dry surfaces on sealing faces. This further assists the maintenance of high quality products and further minimizes the risk to package seal integrity.

If the container pressure is not maintained, semi-rigid containers would collapse after sterilization during the cool down. If rigid containers such as cans are used, it is not as much of a concern, nor is it with collapsible pouches. A typical example, of the range of high temperatures is 100° C. to 200° C. with the pressure ranging from 10 psi to 120 psi to be maintained in the filling chamber 20 and the sealing chamber 40.

When sealed, the finished packages are transferred to a pressure lock 72 which isolates them from the sealing chamber 40.

The transfer mechanism of the pressure lock 72 deposits the packages onto the in-feed section of the sterilizing, cooling and pressure reduction sub-system 50, 60.

The sealed packages are held at sterilizing temperature until "commercial sterility" is achieved. The package temperature is then reduced to below 60° C. at a rate appropriate for the thermal diffusivity of the product. During cooling, the surrounding environment pressure is reduced in stages towards atmospheric pressure, to avoid excess seal stresses and so avoid challenging pack integrity.

The modular construction of the chambers which form the sterilizing, cooling and pressure reduction sub-system and their common sets of controls and connections to the utilities sub-system, allow the chambers to be held at any temperature and pressure from sterilizing to atmospheric conditions. This adds to the flexibility of individual machines and to the flexibility of the system for almost any application.

Sterilizing temperatures and pressures are maintained in the heating chambers by an inert gas and/or by live steam applied either inside the chambers or indirectly via an outer pressurized jacket, both supplied and controlled by the utilities sub-system.

Cooling is effected by high velocity water spray systems, built into the structure of the chambers, which maintain high heat transfer rates at the package surfaces or, where appropriate, cooling is effected indirectly via an outer jacket. Appropriate pressures are maintained during cooling by an inert gas and/or compressed air. Both temperature and pressure are controlled by the utilities sub-system which also supplies cooling water and pressurization gases.

Each chamber in the sub-system 50, 60 is linked to the next by pressure locks 73, 74, 75 which remove packages from the conveyor belt of one chamber, isolate them until the local pressure is the same as that in the next chamber and then deposit them on the conveyor belt in the next chamber.

When the temperature and pressure has been reduced to appropriate levels, packages are delivered from the final cooling chamber to the out feed conveyor to pass on to conventional inspection and secondary packing stations outside the scope of this invention.

Figure 2:
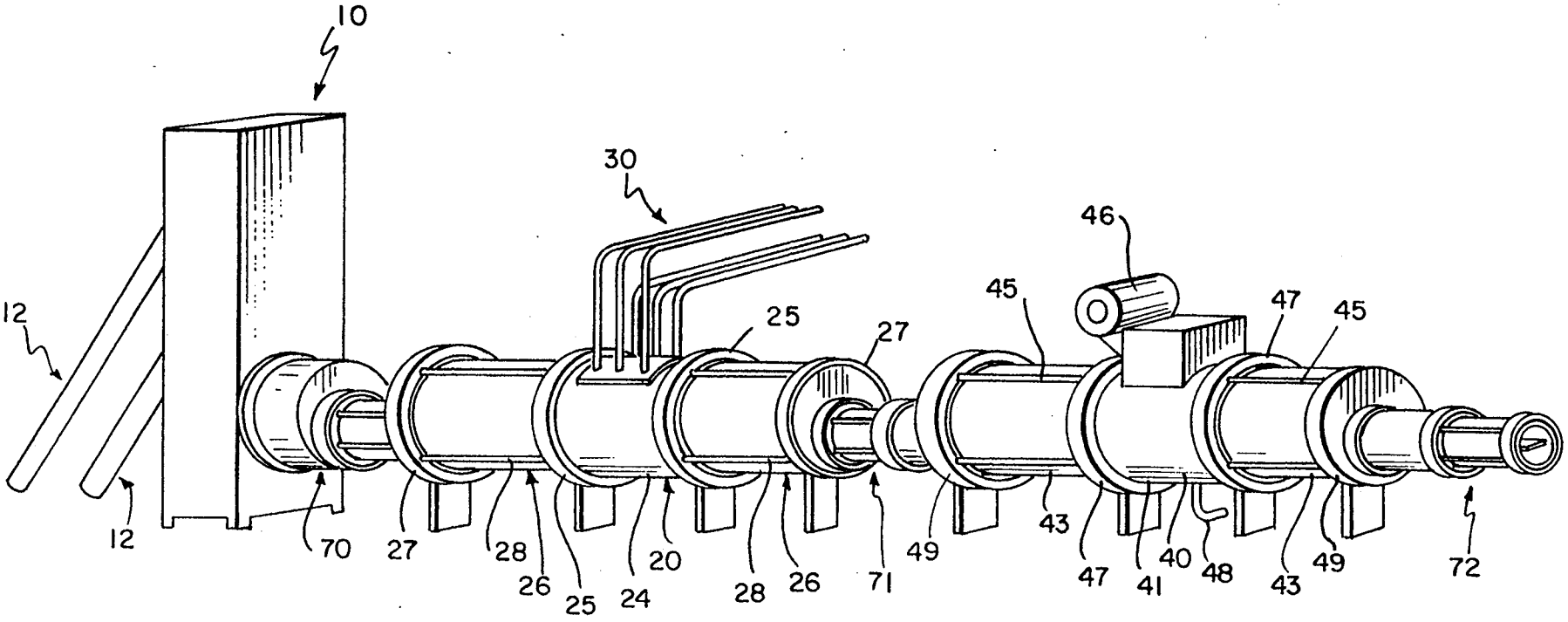
FIG. 2 is a perspective view of the container handling, filling and sealing sections incorporating the principles of the present invention.

Access to the filling and sealing chambers 20 and 40 for routine maintenance, etc. is via a novel telescopic pressure vessel system in which the body of the pressure vessel shells may be disconnected from the ends and pressure locks and moved on guide rails to reveal the working components of the filling and sealing sub-systems. As illustrated specifically in FIG. 2, the filling chamber 20 includes a center section 24 telescopically received on a pair of smaller diameter end sections 26. Circumferentially spaced rails 28 on the exterior of the end sections 26 mate with guides interior of the center section 24 to allow the center section 24 and the end sections 26 to move relative to each other.

Locking rings 25 lock and seal the center section 24 to the adjacent end section 26 and locking and sealing rings 27 lock and seal the end sections 26 to an end structure which is coupled to the respective pressure locks 70 and 71. Removable locking rings 25 will allow the center section 24 to move over either end section 26. Also, removal of locking rings 25 and 27 of one of the end sections 26 will allow that section to be moved into the center section 24. This allows complete access to the interior of the filling chamber 20 without dismantling of the total line. The pressure lock maintains the temperature and pressure in the unaffected portion. The various external components are fixed to the outside of the middle section 24 and either move with the center section or are located on static supports which may be separate from the movable portion of the section by pressure tight slides. Similarly, portions of the end sections 26 may be fixed to allow the remaining portions of the end sections to slide inside the center section 24, past any intruding static equipment.

The sealing chamber 40 also includes a center section 41 telescopically received on a pair of end sections 43 to slide thereon by circumferentially spaced rails 45. The center section 41 includes locking rings 47 connecting and sealing to the end sections 43 and the end sections 43 include locking rings 49 to connect and seal the other ends of the end sections 43 to the interface with a respective pressure lock 71 and 72.

Figure 3:
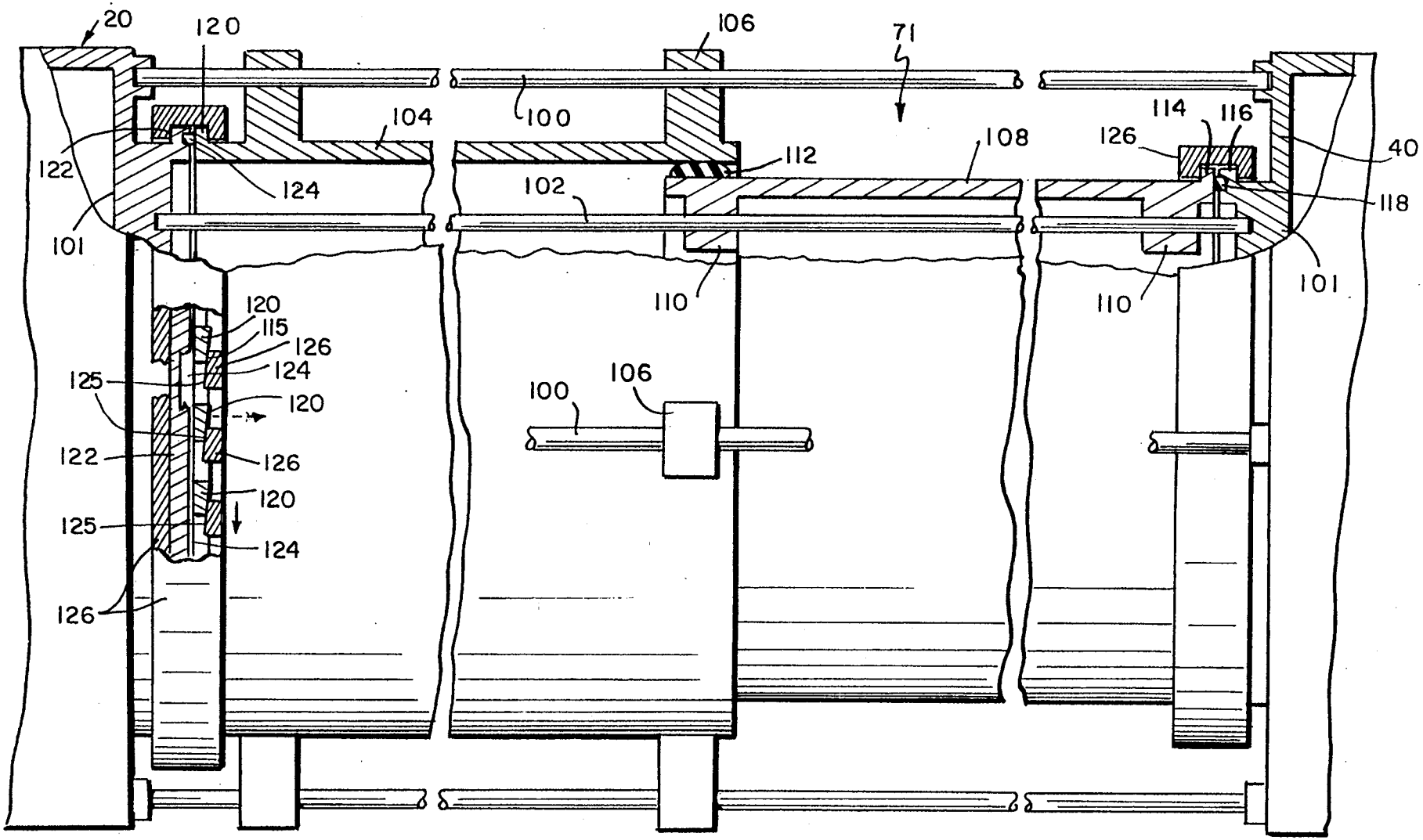
FIG. 3 is a detailed partial sectional view of a pressure lock without the transfer mechanism according to the principles of the present invention.

Access to the insides of the pressure locks is via a similar telescoping body arrangement but which splits in the middle of the lock and slides to each end revealing each lock door in turn. A detail of the rail and guide system as well as the locking and sealing rings for the pressure lock is illustrated in FIG. 3. The same detailed structure and mechanism shown in FIG. 3 for the locks are also used for the filling station 20 and the sealing station 40 described in FIG. 2. Pressure lock 71 is connected between the filling chamber 20 and the sealing chamber 40. The end structure of the filling chamber 20 and the sealing chamber 40 includes rail supports 101 to receive a plurality of outer guide rails 100 and a plurality of inner guide rails 102 circumferentially spaced. The lock includes an outer housing member 104 with slides 106 to receive and slide upon the outer rail 100. The inner housing section 108 includes interior slide 110 which receive and slide along the inner rail 102.

A pressure tight seal 112 is located around the periphery of the inner section 108 and seals the gap between the two sections 104 and 108 to maintain internal pressure. The seal 112 may be easily removed to allow either of the outer section 104 to slide over the inner section 108 or the interior tube 108 to slide inside the exterior tube 104 to reveal the internal mechanisms for service access. A typical example would use four outer rails 100 and four inner rails 102 arranged approximately 90° apart around the circumference. A pressure type door is located on each end of and isolates the environment inside the pressure lock from the environment in the adjacent chambers. These doors are not illustrated in FIG. 3 but are in FIG. 4 for sake of clarity. The rails 100 and 102 are located such that the door extends to the exterior of the chamber between circumferentially adjacent rails.

Quick release sealing rings are used to support, locate and seal the ends of the pressure locks to adjacent chambers. A pair of sealing rings are illustrated as 126. The ring structure described in detail in FIG. 3 are also used for the sealing rings 25, 27, 47, 49 between the housing sections of the sealing station 20 and the filling station 40. The mating end of the inner section 108 includes a mating surface flange 114 adjacent a mating surface flange 116 of the sealing chamber 40. A sealing gasket 118 lies there-between. Similarly, the outer section 104 includes a mating flange 102 adjacent a mating flange 122 of the filling chamber 20 with a sealing gasket 124 there-between. The locking and sealing rings 126 encompasses the mating flanges 114, 116, 120 and 122.

As illustrated for mating flange 114 of the outer section 104, it includes a tapered camming surface 115 which mates with the tapered camming surface 125 on the interior of the locking ring 126. The locking ring 126 is rotated relative to the flange 120, the camming surfaces 115 and 125 engage to force the flange 120 tightly into engagement with flange 122 and compressing the sealing gasket 124. By reverse rotation of the locking ring 126, the seal is quickly broken and the sealing ring 126 may be removed allowing quick disconnect of the inner section 108 or the outer section 104 to allow it to move on the rails relative to the other.

Access to the internal mechanisms of the sterilizing, cooling and pressure reduction sub-system 50, 60 is provided either by complete lift-off sections of the shell or via small removable panels.

Access panels and hatches are also provided where appropriate to allow easy and convenient access for maintenance, adjustment and inspection. A number of illuminated view ports are located at strategic points throughout the machine.

All electrical drives are located outside the various operational chambers for safe electrical connection, ease of maintenance and reliability. Drive shafts pass through the chamber walls via conventional pressure seals.

Standard rotary pressure tight seals (e.g. SKF Bearings, Fenner Bearings) are used to prevent pressure loss from round rotating, drive shafts used to provide required prime movement within each chamber. The shafts used standard couplings, electrical clutches and brakes to move conveyor drives, filling devices and so on.

The number of internal moving parts is minimized to increase reliability and production opportunity and to allow the various chamber volumes to be minimized.

Figure 4:
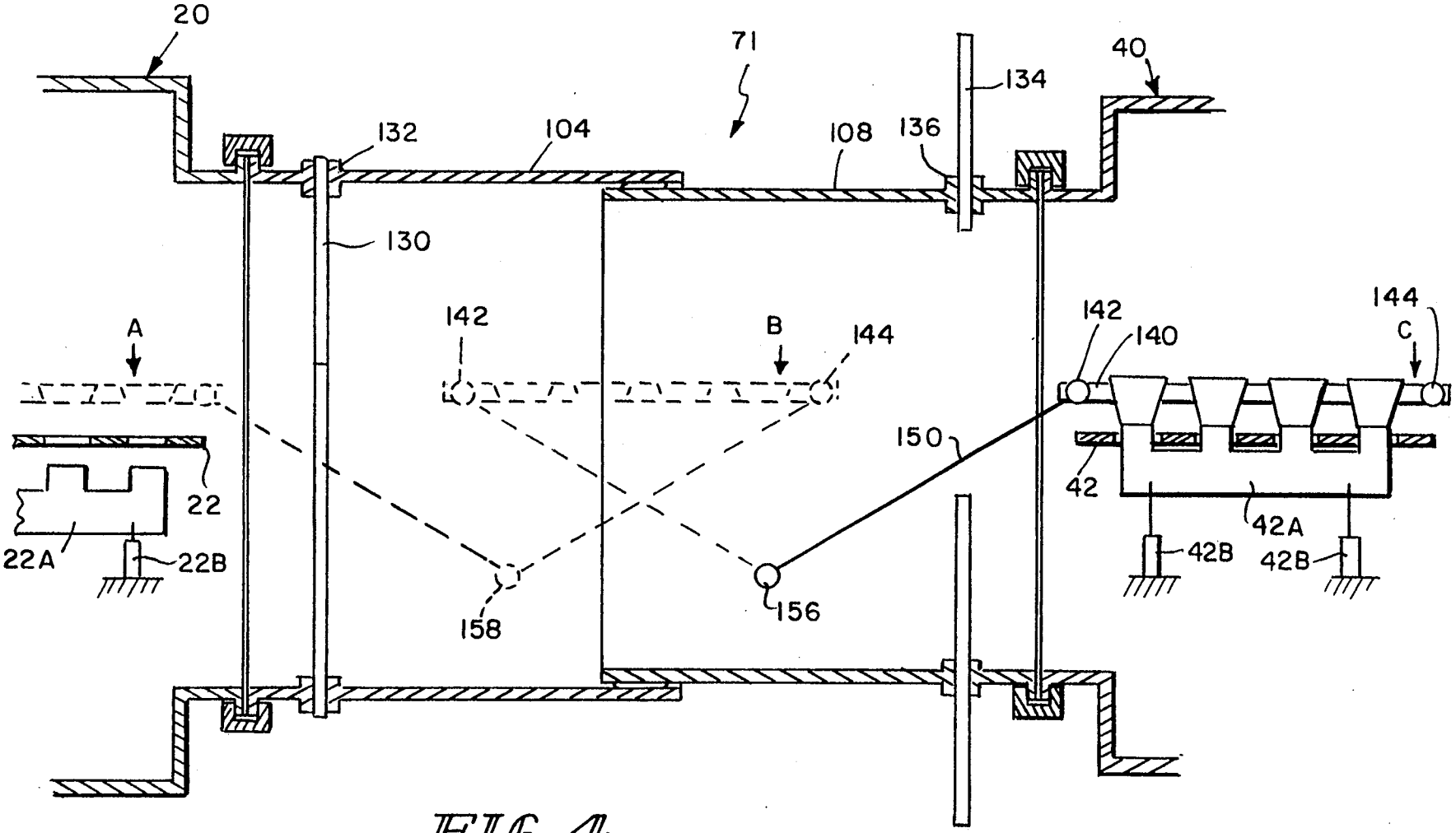
FIG. 4 is a cut-away of the lock showing the lock transfer mechanism.

Details of the transfer mechanism which removes the containers from one section, for example, the filling chamber and transfers it through a lock to another section, for example a sealing chamber, is illustrated in detail in FIG. 4. The sealing chamber 20 includes the filling conveyor 22. A container lift mechanism 32A is shown in the down position and is raised by actuators 22B to raise a plurality of containers up out of the filling conveyor 22. Similarly, in the sealing chamber 40 a lift mechanism 42A operated by actuators 42B lower four illustrated containers with respect to the sealing conveyor 42. The lock transfer mechanism has three basic positions, mainly an extended position, illustrated by dashed lines, where it is extended into a first adjacent chamber A, a retracted position B, also illustrated by dashed lines, where it is basically centered within the interior of the lock and a second extended position C, illustrated in solid lines where it extends into the next adjacent chamber. Although four containers are illustrated as being part of the transfer, other numbers may be used. As will be evident below, the number of containers is related to the number of cycles or incrementations of the filling conveyor 22 and the sealing conveyor 42 which occur during one complete transfer cycle of the transfer mechanism of the lock.

The lock 71 has a load or inlet door 130 received in apertures 132 of the outer section 104 and a seal is provided. An unload or outlet door 134 is provided in the inner section 108 of the lock within openings 136 which also include a seal. The details of FIG. 3 are not included in FIG. 4 for sake of clarity, nor are the operating mechanisms for the doors 130, 134.

The transfer mechanism includes a horizontal clamping device or container gripper 140 and a pair of pivot arms 150 to extend and retract the gripper 140. The container gripper 140 includes two halves which separate transverse to the transfer axis. This would be out of and into the paper of FIG. 4. The gripper halves lightly clamp the containers without damaging their side walls. This is especially critical for semi-rigid and flexible containers. This mechanism is well known and need not be described in detail. Basically two halves may slide along a pair of transverse rails.

Figure 5:
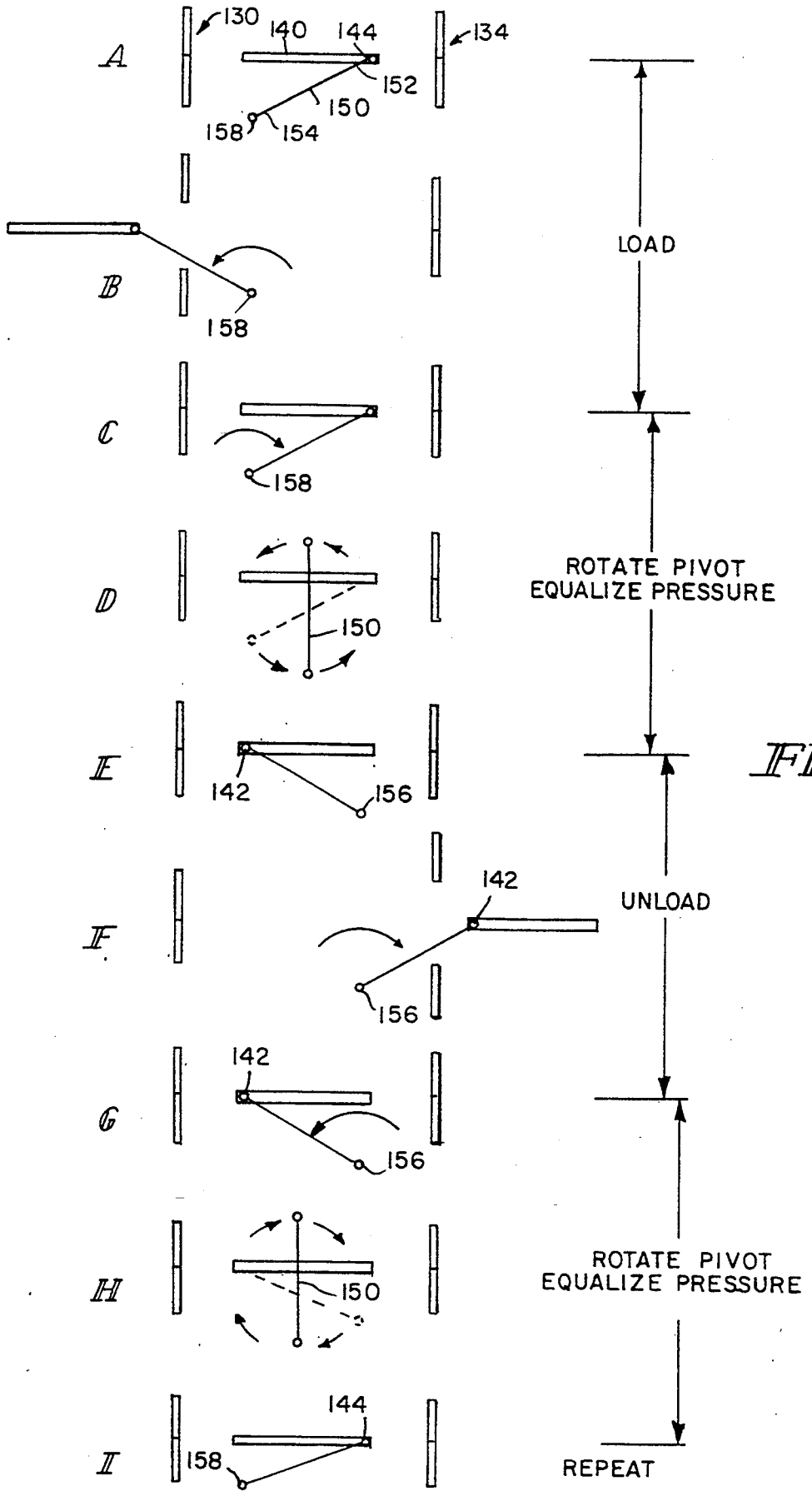
FIGS. 5A through 5I show the lock transfer mechanism at its various stages.

The container gripper 140 includes a first and second pivot position 142 and 144 adjacent to opposite ends of the gripper 140. The pair of pivot arms 150 are selectively connected to one of the pivot positions 142, 144. As illustrated in FIG. 4, the end 152 of pivot arm 150 is connected at the first pivot position 142. The other end 154 of the pivot arm 150 is selectively connected to a first and second pivot points 156 and 158. As illustrated in FIG. 4, the end 154 of the pivot arm 150 is positioned at the first pivot point 156. It should be noted that in the retracted position of the gripper 140, the first pivot position 142 and the first pivot point 156 are diametrically opposed with respect to the length of the lock 71. Similarly, the second pivot position 144 and the second pivot point 158 are also diametrically opposed. As will be explained below with respect to the sequence of FIG. 5, the pivot arms 150 are pivoted about the first pivot point 156 with the other end of the pivot arm 152 being in the first pivot position 142 to extend and retract the variable 140 into and out of the sealing chamber 40. The pivot arm 150 is then adjusted such that end 152 of pivot arm 150 is connected to the second pivot position 144 and end 154 is adjusted to the second pivot point 158 to extend and retract the gripper 140 into and out of the filling chamber 20. The mechanism for moving and locking the pivot points and pivot positions is not shown in detail for sake of clarity. Any mechanism well within the skill of the art may produce the appropriate positioning or selection of the pivot position and pivot points. The ends of the pivot arms 150 may be locked into place by mechanical locks or detents and guides with pins may be used to define the travel path of the pivot arms 150 between its various positions as well as during the adjustment of the pivot points and pivot positions. Hydraulic or other actuators may be used, not only to pivot the arms once they are locked into their pivot positions and points, but also to move them between their various pivot positions and points.

At the beginning of a sequence, the pivot arm 150 has its end 154 at pivot point 158 and end 152 connected to the gripper 140 at the pivot position 144 and assumes position B, generally centered between the two doors 130 and 134 of the pressure lock. Lift 22A is raised by actuary 22B to raise four containers up out of the filling conveyor 22. This initial position is illustrated in FIG. 5A.

The load door 130 is opened and the container gripper 140 is opened. The pivot arms 150 are rotated about pivot point 158 to swing and extend the gripper 140 in a slight horizontal arc into the adjacent filling chamber 20 as shown in FIG. 5B. The gripper 140 closes on four containers.

The pivot arms 150 are rotated about pivot point 158 again and return or retract the gripper 140 into the lock as show in FIG. 5C. The slight horizontal arc prescribed by the gripper motion provides lift for the containers so that their contents are handled gently and are not damaged. Once the container gripper is clear of the load door 130, the door 130 is closed and the pressure inside the lock is changed to that of the next downstream chamber 40.

The pivot arms 150 are repositioned for example by rotating about a point midway along their length, so that end 152 is moved from pivot position 144 to pivot position 142 on the gripper 140 and the end 154 is moved from pivot point 158 to pivot point 156. This is illustrated in FIG. 5D with the resulting position represented in FIG. 5E.

When the pressure matches that of the downstream chamber 40, the unload door 134 opens, the pivot arms 150 rotate about pivot point 156 and the container gripper transfers its load into waiting pockets on the downstream chamber conveyors 42. Again, the slight arc prescribed by the gripper 140 provides lift for the container so that when the gripper 140 is released, the containers are gently located in the pockets of the downstream conveyor 42. The actuator 42B lowers lift 42A and the containers into the sealing conveyor 42. This is illustrated in FIG. 5F.

The container gripper 140 is then moved back into the pressure lock by rotation of pivot arms 150 about pivot point 156 as illustrated in FIG. 5G. When clear, the unload door is closed and the internal pressure is changed to match that of the upstream chamber 20 again.

Next, pivot arms 150 are repositioned such that end 152 is moved from pivot position 142 to pivot position 144 on the gripper 140 and end 158 is moved from pivot point 156 to pivot point 158. The transition is illustrated in FIG. 5H with the final position being illustrated in FIG. 5I.

At this point, the mechanism and the lock are ready to repeat the cycle.

Note that container lift mechanisms 22A and 22B are positioned beneath the filling chamber conveyor 22 to lift containers clear of the conveyor pockets just as they are grasped by the container gripper 140. A similar mechanisms 42A, 42B is positioned beneath the conveyor in the downstream sealing chamber 40 to ensure containers are relocated gently into conveyor pockets.

The transfer mechanism sequence takes place during the time taken for the whole machine to make four indexes. The container gripper 140 acquires four containers from the upstream chamber during the time the machine is at rest prior to the "first index". The load door 130 is closed, the pivot arms 150 are repositioned and pressure is changed over the duration of the "first and second indexes". The containers are unloaded during the time when the machine is at rest prior to the "third index". The unload door 134 is closed, the pivot arms 150 are repositioned and pressure is changed over the duration of the "third and fourth indexes" so that the mechanism is ready to repeat its sequence in time for the "fifth (new first) index".

The size of the transfer mechanism with the relocation of the pivot arms 150 provides increased lateral extension into the adjacent chambers with minimum vertical lift. This minimizes the disturbances or spillage and reduced the size of the losses.

Figure 6:
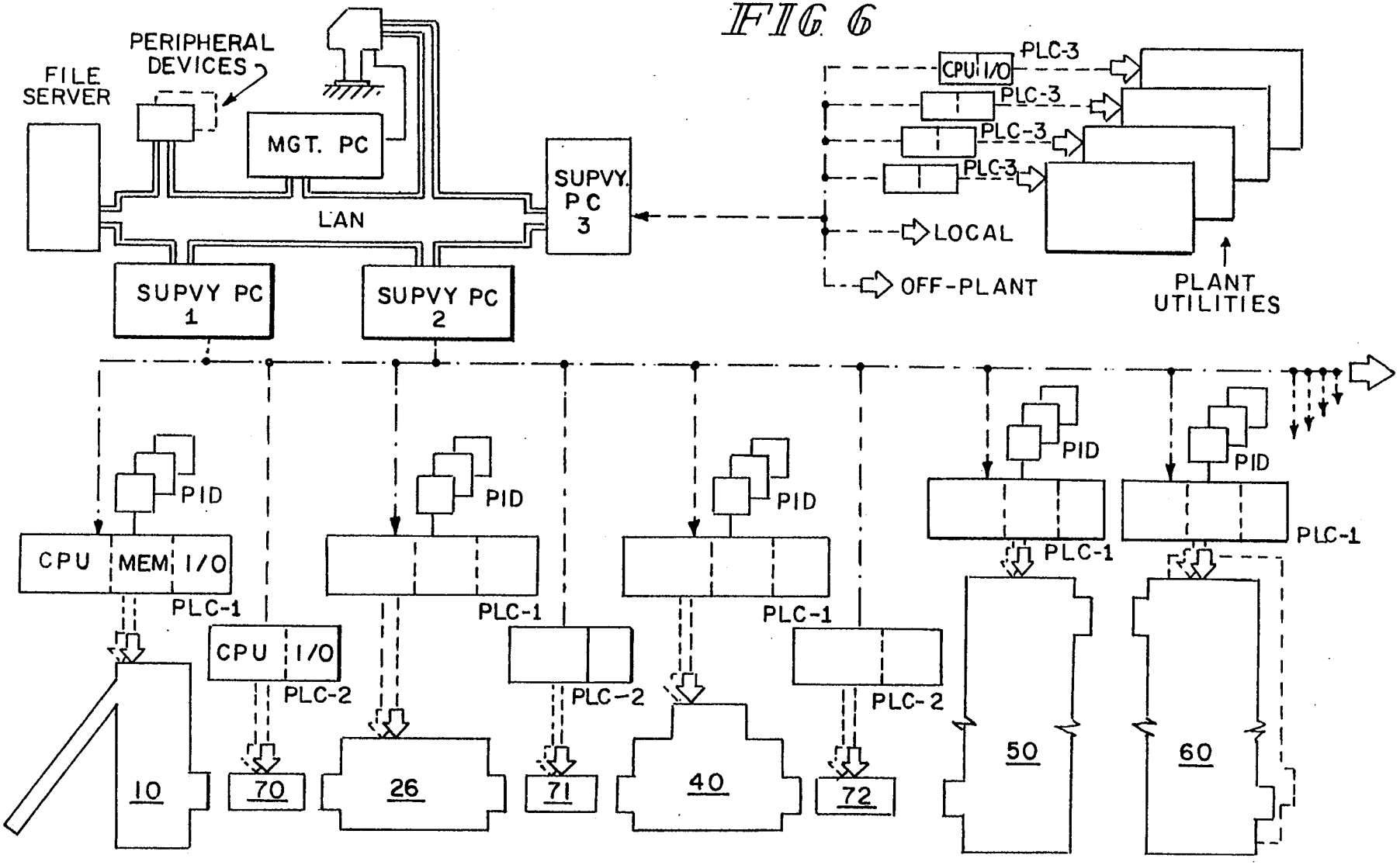
FIG. 6 is a block diagram of the process controller according to the principles of the present invention.

As illustrated in FIG. 6, there are three levels of process control, plant wide programmable logic controllers PLC-1 and PLC-2 connected together and at least two supervisory PCs, connected via a local network (LAN) to a management PC which serves as the host for the plant operator.

A file server is also connected to the LAN to provide LAN management, secure data storage and retrieval and to manage a series of peripherals which includes printers, plotters, tape back-up devices and an external communications system.

The utilities (steam, air, water and nitrogen plant) have their own control systems but are monitored by watchdog PLCs (PLC-3) which also regulate and manage the output of their respective media (steam, air, water and nitrogen) by demand and in terms of operational efficiencies. This set of PLCs is also connected to a supervisory PC which is in turn connected to the LAN.

Each component section of the process plant is equipped with a complete set of sensors, drives, actuators and control valves all connected to a PLC comprising CPU, memory, analog and digital input and output as appropriate. In additional critical PID control loops are managed by discrete controllers which are also connected to the PLC. The arrangement provides sufficient control and operational software, to permit each section of the process plant to be operated in solation and independently from other sections of the process plant and, in the instance of communications failures, provides a means of semi-automatic operation.

Electrical connections to the plant are made at this level. PLC outputs are directed to switchgear located elsewhere within the section of the plant. Communications between PLCs and the supervisory PCs is via a full duplex, plant wide link. Standardized software routines are used throughout the programming of the PLCs (and the PCs) and standard routines are used for passing data up and down the communications link.

The supervisory PCs major roles are the management and overall operation of the plant (process and utilities) and the collection and dissemination of data. They also provide capacity for decision making at a relatively low (close to plant operation) level and thus cope with minor, transient process deviations where they influence plant operation (and not food sterilization). The utilities supervisory PC is responsible for ensuring the correct provision of services in the most efficient manner and also acts as the maintenance advisor by monitoring the performance of both the utilities and the process plant (collecting data from the file server via the LAN) and offering advice about planned maintenance, breakdowns, fault finding and other preventative maintenance functions.

The utilities supervisory PC is connected to local site services and also acts as the pipeline for data transmitted from off plant equipment (used, for example, to prepare and pre-heat food) to the file server, ensuring the correct supply of raw (food) materials to the process plant.

The management PC provides an intelligent link between the process plant (and the vast amount of data passing between the plant, PLCs and PCs) and the plant operator(s), providing the "human interface" via a specially constructed console. The entire range of sensors and control functions available on the process plant, within the utilities and connected to "off-plant" equipment, are accessible from the operator(s) console. Process data is entered via the operator(s) console and passed via the LAN and the duplex link, to the appropriate PLC or PID controller. The management PC also provides system programming functions and has access (password controlled at various levels) to all the software on the entire system. Management data requests (production data) and thermal process assurance records are handled by the management PC by initiating standardized reports which are generated by the file server.

The file server provides secure duplexed, mirrored data storage, including automatic data back-up facilities and manages a range of peripherals which includes a modem used for remote system access for off-site analysis of system faults, for remote software update and remote data retrieval.

The construction of the machine is essentially modular in concept. The wide range of process and operational units are designed to fit together to suit a specific application or to be rearranged as applications change. The principles and standards of "hygienic design" are used throughout the machine. The materials of construction are in line with the high standards required by the food industry and are generally stainless steel.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A system for packaging and sterilizing food comprising:

first means for raising the temperature and pressure of a container to a filling temperature and pressure;

second means for filling said container with food in an inert gas environment and at said filling temperature and pressure sufficient to minimize production of steam;

third means for feeding said food at said filling temperature to said second means;

fourth means for sealing said filled container in an inert gas environment and at said filling temperature and under pressure sufficient to maintain said inert gas under pressure in said sealed container; and fifth means for sterilizing said filled container and sequentially reducing the temperature and pressure of said sterilized container.

2. A system according to claim 1, including pressure lock means for interconnecting at least one of said first and second means, said second and fourth means, and said fourth and fifth means and for maintaining pressure in at least one of said second and fourth means.

3. A system according to claim 1, wherein said fifth means includes at least a sterilization stage and at least one cooling and pressure reduction stages for bring the environment of said container to ambient temperature and pressure without collapsing said container.

4. A system according to claim 1, wherein said temperature in said first, second, third and fourth means may be different from each other, but no less than 100° C.

5. A system for packaging and sterilizing food comprising:

first means for supplying containers;

second means for filling said container with food;

third means for feeding said food to said second means;

fourth means for sealing said filled containers;

fifth means for sterilizing said filled container and subsequently reducing the temperature of said sterilized containers; and at least one of said second and fourth means including a housing having a container inlet and a container outlet, a first housing section and a second housing section telescopically mounted to said first housing section for providing access to said means.

6. A system according to claim 5 including at least one lock means, interconnecting at least one of said first and second means, said second and fourth means, and said fourth and fifth means, for maintaining the environment in at least one of said second and fourth means.

7. A system according to claim 6, including sixth means, having individual separate segments in each of said first, second, fourth and fifth means and in each of said lock means, for transporting said containers through said system.

8. A system according to claim 7, wherein said sixth means segments in said first, second, fourth and fifth means includes conveyors therein; and said sixth means segments in said lock means includes transfer means for extending into adjacent means and transferring containers between said adjacent means.

9. A system according to claim 7, wherein said sixth means includes drive means exterior said first, second, fourth and fifth means for driving said segments therein.

10. A system according to claim 7, wherein said sixth means includes individual controllers for each of said segments and a central controller for coordinating each of said individual controllers.

11. A system according to claim 6, wherein said lock means includes:

a first housing section having a container inlet; and a second housing section having a container outlet and being telescopically mounted to said first housing section for providing access to said lock means.

12. A system according to claim 11, wherein said lock means each include a pair of lock rings for mounting a respective housing section to a respective means.

13. A system according to claim 5, wherein said fifth means includes at least a sterilization stage and at least one cooling and pressure reduction stages, each interconnected by a lock means.

* * * * *